US012543881B2

(12) United States Patent
Dunagan

(10) Patent No.: US 12,543,881 B2
(45) Date of Patent: Feb. 10, 2026

(54) SECURITY PACKAGE DELIVERY SYSTEM AND METHOD

(71) Applicant: Neil L. Dunagan, Spokane Valley, WA (US)

(72) Inventor: Neil L. Dunagan, Spokane Valley, WA (US)

( * ) Notice: Subject to any disclaimer, the term of this patent is extended or adjusted under 35 U.S.C. 154(b) by 287 days.

(21) Appl. No.: 17/950,329

(22) Filed: Sep. 22, 2022

(65) Prior Publication Data

US 2024/0099491 A1 Mar. 28, 2024

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01)

(58) Field of Classification Search
CPC .... A47G 29/20; A47G 29/141; A47G 29/124; A47G 29/1216; A47G 29/122; A47G 29/30; A47G 29/28; E06B 7/32; E05G 7/00
USPC ..... 232/38
See application file for complete search history.

(56) References Cited

U.S. PATENT DOCUMENTS 6,323,782 B1 * 11/2001 Stephens ..... G07C 9/00571 340/5.73
6,426,699 B1 * 7/2002 Porter ..... A47F 10/00 340/568.1
6,484,531 B1 * 11/2002 Hambleton ..... F25D 23/10 312/286
6,967,575 B1 * 11/2005 Dohrmann ..... G06Q 20/367 340/5.31
7,191,932 B2 * 3/2007 Fobbe ..... A47G 29/141 232/39
7,748,627 B2 7/2010 Gelbman
8,413,821 B2 4/2013 Johnson et al.
9,508,204 B2 11/2016 Oz et al.
9,531,694 B2 * 12/2016 Alt ..... H04L 63/067
9,635,006 B2 4/2017 Oz et al.
9,821,768 B2 11/2017 Oz et al.
10,037,636 B2 7/2018 Ho et al.
10,180,016 B2 1/2019 Critz
10,393,589 B2 8/2019 Fadell et al.
10,464,206 B2 11/2019 Frisby et al.
10,512,353 B2 12/2019 Chambers et al.
10,736,451 B2 8/2020 Chambers et al.
10,743,693 B2 8/2020 Newcomb
10,750,894 B2 8/2020 Chambers et al.
10,769,875 B2 9/2020 Arellano et al.
10,800,577 B2 10/2020 Blubaugh
11,928,642 B2 * 3/2024 Ruocco ..... G07C 9/00896
11,980,309 B2 * 5/2024 Chowdhury ..... H04L 9/321
(Continued)

FOREIGN PATENT DOCUMENTS

CA 2867597 A1 * 10/2013 ..... A47G 29/22
CA 2835025 A1 * 5/2014

*Primary Examiner* — William L Miller
(74) *Attorney, Agent, or Firm* — Wells St. John P.S.

(57) ABSTRACT

A security package delivery system is provide having at least one wall, a door frame and a door. The door frame is affixed to the at least one wall having a circumferential frame with a door mounting frame inset into a recess relative to a front surface of the door frame. The door has a hinge rod extending through the door frame affixed at each end within a receiving bore of the frame. A method is also provided.

22 Claims, 9 Drawing Sheets

(56) References Cited

U.S. PATENT DOCUMENTS

2002/0035857 A1* 3/2002 Stein ..... A47G 29/141 70/277
2003/0127504 A1* 7/2003 Hill ..... A47G 29/1201 232/38
2004/0206000 A1 10/2004 Yamamoto
2007/0194096 A1* 8/2007 Pittman ..... A47G 29/1218 232/45
2009/0101711 A1* 4/2009 Grayson ..... G07C 9/29 235/382.5
2009/0166403 A1* 7/2009 Volpe ..... G07C 9/00912 235/375
2011/0041573 A1* 2/2011 Giles ..... G07C 9/00674 70/278.1
2015/0305538 A1 10/2015 Sundaresan
2015/0320248 A1* 11/2015 Hempsch ..... A47G 29/14 232/30
2016/0300187 A1 10/2016 Kashi et al.
2017/0251856 A1 9/2017 Schaible
2017/0286905 A1* 10/2017 Richardson ..... G06Q 10/0836
2018/0070753 A1* 3/2018 Eveloff ..... H04W 4/025
2018/0202199 A1 7/2018 Critz
2018/0261030 A1 9/2018 Arellano et al.
2019/0177089 A1 6/2019 Benefield
2019/0269268 A1 9/2019 Blubaugh
2020/0000261 A1 1/2020 Chambers et al.
2020/0015617 A1 1/2020 Gonzalez
2020/0060460 A1 2/2020 Farrar et al.
2020/0064814 A1 2/2020 Newcomb
2020/0154923 A1 5/2020 Chambers et al.
2020/0271358 A1* 8/2020 Oh ..... F25D 31/005
2020/0275795 A1* 9/2020 Campodonico .. A47G 29/12095
2021/0339905 A1* 11/2021 Darkwah ..... E05B 65/52
2022/0125230 A1* 4/2022 Jordan ..... A47G 29/141
2023/0200578 A1* 6/2023 Chhina ..... A47G 29/1251 232/24
2023/0397749 A1* 12/2023 Knox ..... A47G 29/20
2023/0404308 A1* 12/2023 Balding ..... E06B 7/32

* cited by examiner

SECURITY PACKAGE DELIVERY SYSTEM AND METHOD

TECHNICAL FIELD

The technical field is generally related to the field of secure package delivery. More particularly, the present technical field pertains to package lock boxes for receiving and securing packages from delivery services.

BACKGROUND

It was previously known to deliver packages onto porches, as well as place them into secure delivery boxes or mail boxes. Recently, an increase in home delivery services has occurred as a result of stay-at-home provisions resulting from a global pandemic. A concomitant increase in package theft has also occurred which has challenged sellers and buyers. Accordingly, improvements are needed to protect against package theft. For example, drug representatives are known to receive controlled substances in rural residential locations which can pose a threat of theft for such controlled substances and there exists a need for a more secure delivery solution.

SUMMARY

A security box apparatus and method are provided for securely delivering and storing delivered packages at a building or residence. A self-powered option provides increased application for uses remote from a power grid. An inset hinged door assembly utilizes welded, trapped assemblies that reduce or eliminate mechanical leverage arm advantage if a thief tries to pry open the security box. Assembly geometric makes it difficult for an individual to pry away the security door from the frame in order to gain entry to packages.

According to one aspect, a security package delivery system is provided having at least one wall, a door frame and a door. The door frame is affixed to the at least one wall having a circumferential frame with a door mounting frame inset into a recess relative to a front surface of the door frame. The door has a hinge rod extending through the door frame affixed at each end within a receiving bore of the frame.

According to another aspect, a security package delivery system is provided having a door frame and a door. The door frame is configured to be affixed to a wall portion having a circumferential frame with a door mounting frame recessed relative to a front surface of the circumferential frame. The door has a hinge rod extending through the door frame affixed at each end within a receiving bore of the frame. The hinge rod is affixed to a door panel with each end of the hinge rod entrapped within opposed pivot bores within the door frame.

According to yet another aspect, a method is provided for securing a package. The method includes: providing a storage encasement having a wall portion, a frame affixed to the wall portion, a door, a rod hinge extending at opposed ends through bores in the frame both recessed relative to a front surface of the frame, and a locking latch assembly configured to affix the door and the hinge in a recessed closed position within the frame; entrapping the door and the hinge rod by affixing the door to the hinge rod while the hinge rod is entrapped within the bores of the frame; and locking the door and the hinge rod in a recessed position relative to a front surface of the frame with the locking latch assembly.

DETAILED DESCRIPTION OF THE ILLUSTRATED EMBODIMENTS

This disclosure of the invention is submitted in furtherance of the constitutional purposes of the U.S. Patent Laws "to promote the progress of science and useful arts" (Article 1, Section 8).

Figure 1:
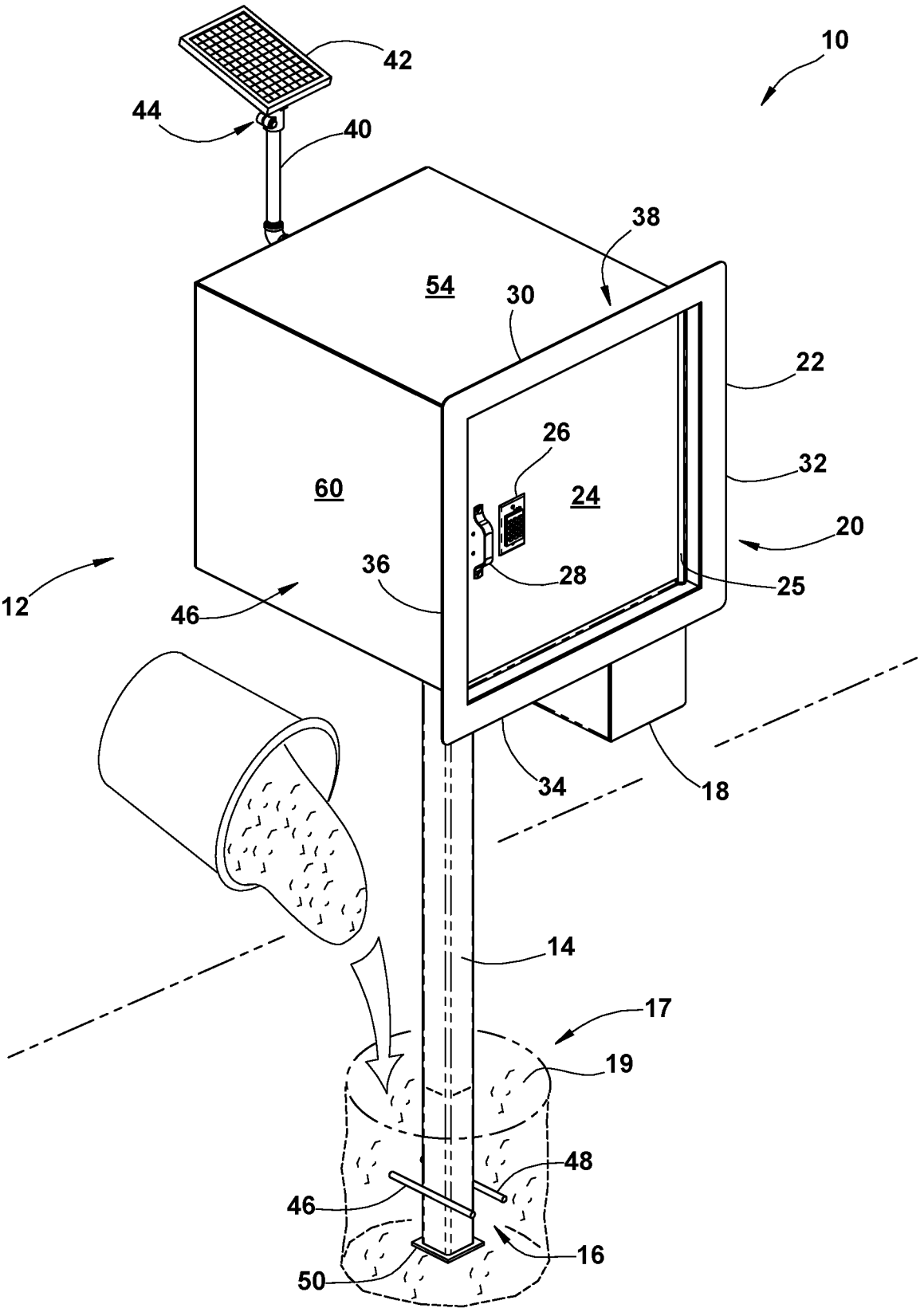
FIG. 1 is a perspective view from above and in front of a secure package delivery system 10 according one aspect.

FIG. 1 is a perspective view from above and in front of a secure package delivery system 10 according one aspect. System 10 includes a security box 12 and a base post 14 having a retention base 16. Base 16 includes a pair of steel rod, or rebar segments 46 and 48 welded onto a distal end of a rectangular steel post 14 perpendicular to a central axis to provide retention and support when embedded in a concrete base 19 poured into a foundation hole 17 excavated within a desired ground location on a user's property. For example, hole 17 can be provided adjacent a driveway of a home or a business accessible by a delivery vehicle (not shown). A square rectangular plate 50 is welded to a distal end of post 14. According to one construction, security box 12 is formed by welding together steel plate and angle iron components forming security box 12 including secure battery box 18, security door assembly 20 and wall segments 54, 56, 58, 60 and 62 (see FIGS. 2-5). Optionally, security box 12 can be constructed from an alternative metal, aluminum, hardened steel, high strength steel, composite or other suitable structural material that renders security box with sufficient strength to reduce or eliminate risk of damage during an attempt to breach box 12.

As shown in FIG. 1, security door assembly 20 comprises a door frame 22 formed as a right angle steel framework 38 welded onto a front face of a steel box body 46. Framework 38 comprises a welded together rectangular array of four right angle steel frame members 30, 32, 34 and 36. A steel plate door 24 is pivotally affixed into framework 38 with a hardened steel hinge rod 25 at top and bottom ends. Rod 25 is welded along an edge of door 24. An access key pad 26 and a handle 28 are affixed onto an outer surface of door 24 to enable secure user access by a user having a security code.

Also shown in FIG. 1, secure package delivery system 10, according to one construction, can have a solar panel 42 supported for favorable solar capture orientation via an adjustable tilting and pivoting collar 44 atop of a vertical pipe mast post 40 affixed onto a back end of box body 46.

Figure 4:
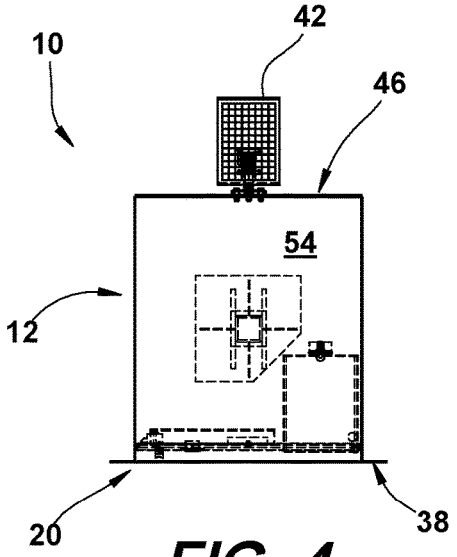
FIG. 4 is a plan view from above of the secure package delivery system of FIG. 2.
Figure 5:
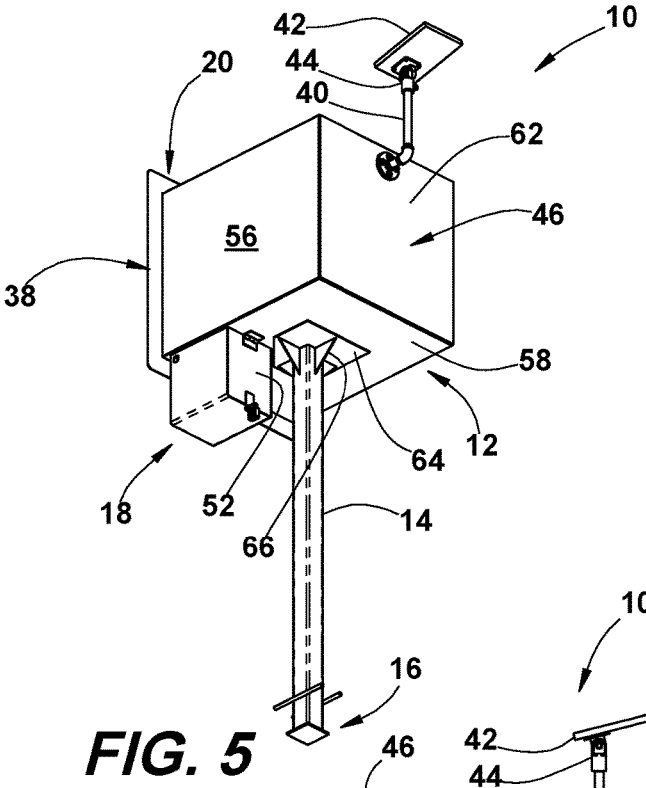
FIG. 5 is a perspective view from behind and below of the secure package delivery system of FIG. 2.
Figure 2:
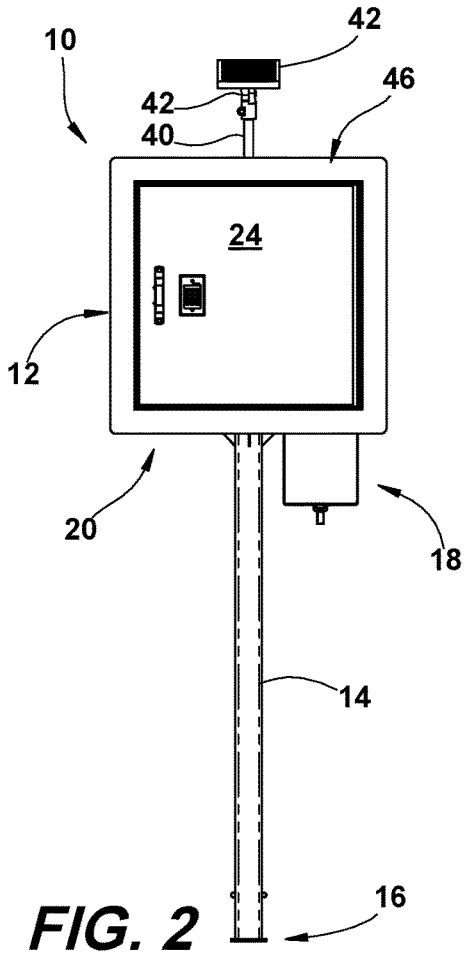
FIG. 2 is a front view of the secure package delivery system of FIG. 1.
Figure 3:
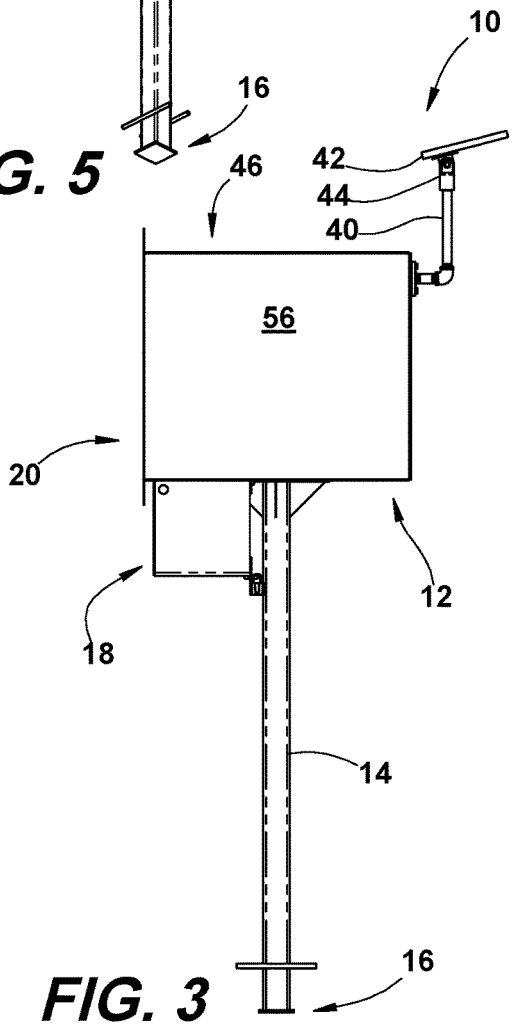
FIG. 3 is a right side view of the secure package delivery system of FIG. 2.

FIGS. 2-5 variously illustrate construction of secured package delivery system 10 showing component details of security box 12 affixed atop support post 14. FIG. 2 is a front view of then secure package delivery system 10 of FIG. 1. FIG. 3 is a right side view of the secure package delivery system 10 of FIG. 2. FIG. 4 is a plan view from above of the secure package delivery system 10 of FIG. 2. FIG. 5 is a perspective view from behind and below of the secure package delivery system 10 of FIG. 2. FIGS. 2-3 and 5 illustrate a post anchor assembly 14 affixed, or welded to a bottom end of steel square post 14. Post anchor assembly 14, in use, is inserted into a hole in the ground, after which concrete is poured into the hole in order to affix system 10 into a secure inground installation. Furthermore, a steel secure battery box 18 is affixed, or welded onto a bottom surface, or wall 58 (see FIG. 5) of box 12 sized to house a battery securely locked within box 12 via a pivotally affixed hinged door 52 (see FIG. 5) having a padlock hasp and lock.

In addition, FIGS. 2-5 show provision of security door assembly 20, affixed, or welded onto a front edge of body 46 of box 12. Door 24 (see FIG. 2) is pivotally affixed within a recessed position relative to outer right angle frame 38 (see FIG. 4-5). Door assembly 20 can be preassembled, then welded onto a front face of box 12.

Solar panel 42 of FIGS. 2-4 can be tilted and rotated into an optimal position to capture solar energy depending on placement of system 10 into a hole in the ground. Resulting captured solar energy is used to trickle charge a battery (not shown) provided in battery box 188 (see FIGS. 2-3 and 5) and a charging wire harness and trickle charge controller (not shown) couples such solar panel with a battery. The battery supplies power to a keypad and lock control unit 69 (see FIG. 7) that receives a lock combination from a user from keypad 26 to actuate and unlock lock assembly 68 (see FIG. 11). Solar panel 42 is mounted with a rotatable tiltable clamp pipe bracket 44 (see FIGS. 3 and 5) affixed atop a vertical pipe mast 40 (see FIGS. 2-3 and 5) mounted to a back side 62 of box 12, as shown in FIG. 5. Although mast 40 is shown affixed, or welded onto back panel 46 (with an internal pass-through wiring hole in panel 46), it is understood that mast 40 can be affixed onto any other panel including top panel 54 (see FIG. 4) or side panel 56 (see FIGS. 3 and 5). Further optionally, solar panel 42 may not be needed and system 10 could be wired directly to a grid power supply, or optionally use an internal battery.

FIG. 5 further illustrates one suitable construction for affixing support post 14 onto a bottom surface 58 of security box 12 using a welded steel plate assembly comprising a steel horizontal top plate 64 welded atop post 14 using four distinct triangular rips 66 welded onto individual outer surfaces of square pot 14. Optionally, any structural components of system 10 can also be made of welded aluminum or any other suitable fastener affixed structural materials.

Figure 6:
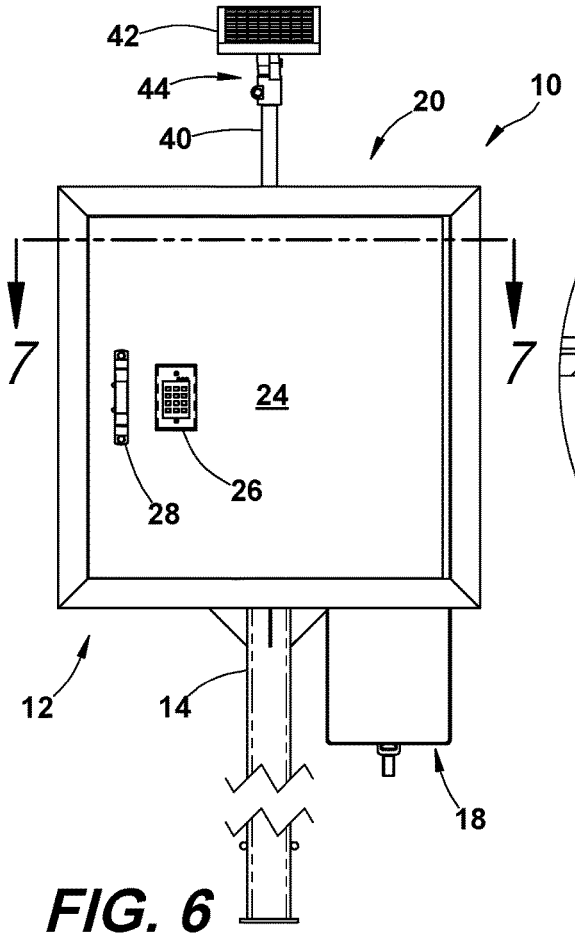
FIG. 6 is an enlarged and partially removed front view of the secure package delivery system of FIG. 2.

FIG. 6 is an enlarged and partially removed front view of the secure package delivery system 10 of FIG. 2. Security door assembly 20 of security box 12 is shown in front view with keypad 26 and handle 28. Security box 12 is affixed atop post 14 and battery box 18 is affixed, or welded onto a bottom surface of box 12. An electrical wiring harness (not shown) is routed from solar panel 42 through pipe bracket 44 and pipe mast 40 (and associated bottom pipe elbow) into security box 12 where it is routed internally through a hole in the bottom plate into battery box 18 for connection to a charge controller and battery (not shown).

Figure 7:
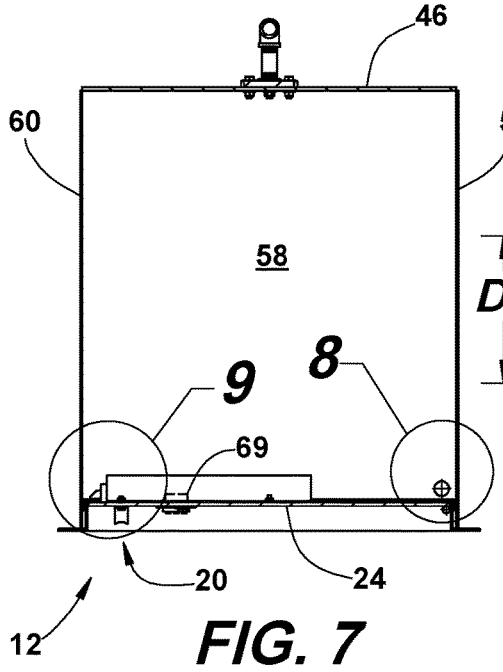
FIG. 7 is a horizontal sectional view taken along line 7-7 of FIG. 6 showing the security door in a closed position.

FIG. 7 is a horizontal sectional view of security box 12 taken along line 7-7 of FIG. 6 showing the security door 24 of door assembly 20 in a closed position. Bottom panel 58 is shown with a wiring access hole 72 (see FIG. 8) for an electrical wiring harness bounded by side panels 56 and 60 and back panel 46.

Figure 8:
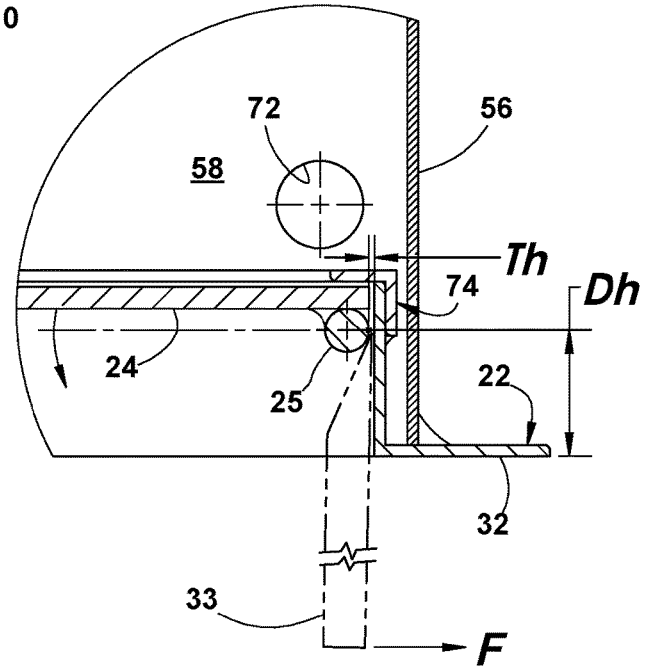
FIG. 8 is an enlarged view of the door and hinge taken from encircled region 8 of FIG. 7.

FIG. 8 is an enlarged view of the door 24 and hinge pin 52 integrally welded onto door 24 and taken from encircled region 8 of FIG. 7 where door 24 is pivotally affixed to door frame 22. Door frame 22 is formed by welding together a large right-angle steel member 32 and a smaller right angle steel member 74 which forms a door stop flange for door 24. Top and bottom ends of pin 25 are physically trapped in top and bottom members of door frame 22. Door frame 22 is then inserted and welded onto the security box, such as alongside panel 56 with a continuous weld, or with a series of closely spaced apart elongate weld segments, such as between member 32 and side panel 56.

As shown in FIG. 8, inner right angle frame assembly 74 is inset approximately 2 inches from outer right angle frame assembly 22. Other inset depths are also possible as long as they result in a geometry that forces a tip of a pry bar 33 to be placed substantially perpendicular to door 24 or hinge rod 25 so as to give little or no fulcrum mechanical advantage to a user trying to pry door 24 and/or hinge rod 25 outwardly from within the inset formed between frame assembly 74 and frame assembly 22. For example, alternate inset depths might include greater than 2 inches, 1.5 inches, 1 inch, 0.75 inch, 0.5 inch, or 0.25 inch, not to be limiting, as long as it results in a geometry for a fulcrum, or pry bar that provides little or no fulcrum mechanical advantage for prying a door from a frame. Generally, forces generated by pry bar 33 in such a position will merely move door 24 in plane against an outer side of frames 72 and 22 and will not result if prying door 24 outward of the inset in which it is mounted, greatly increasing difficulty for a user trying to breach integrity and security of such door mount. The location of hinge rod 25 welded, or affixed onto door 24 results in a depth, Dh, between a center axis of rod 25 and a front edge of frame 22.

Door is accurately cut with a laser cutter to provide a minimal door-to-frame gap, $T_g$, between an outer edge of door 24 and an inner surface of member 32 on frame 22. Exemplary dimensions for $T_g$ include 1/32 inch, or 1/16 inch, but can be larger or smaller as long as such dimension reduces or eliminates the ability to insert a significant structural end portion of a pry bar 33 therein to impart leverage.

Figure 9:
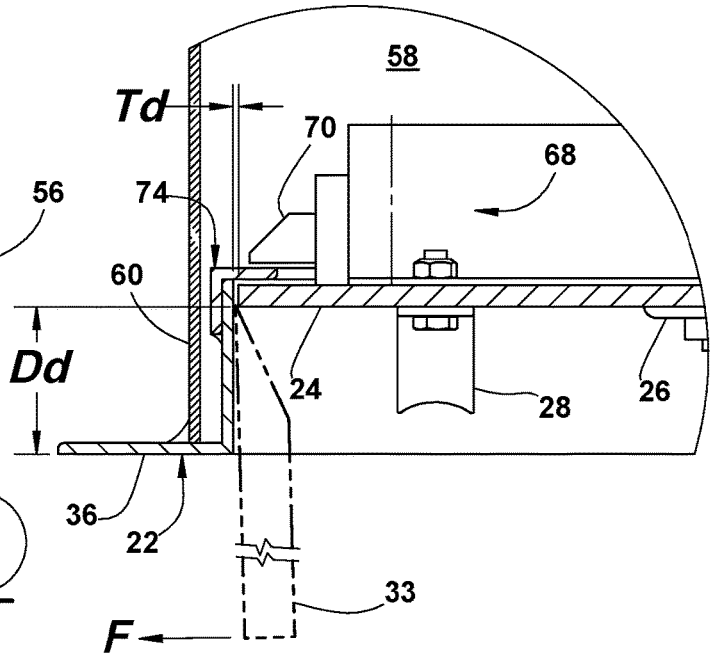
FIG. 9 is an enlarged view of the door and latch assembly taken from encircled region 9 of FIG. 7.

FIG. 9 is an enlarged view of the door 24 and latch assembly 68 taken from encircled region 9 of FIG. 7 where door 24 releasably latches onto door frame 22. Right angle member 36 is welded onto side panel 60 and right angle member 74 is welded onto member 36. Door 24 is pivotally affixed above bottom panel 58 and includes handle 28 and keypad 26. An illustrated inset depth of frame 74 relative to a front surface of frame 22 provides a geometry so that a tip of a pry bar 33 will be placed substantially perpendicular to door 24 so as to give little or no fulcrum mechanical advantage to a user trying to pry door 24 outwardly from within the inset formed between frame assembly 74 and frame assembly 22. The location of door 24 results in an offset depth, Da, between door 24 and a front edge of frame 22. Door 24 is accurately cut with a laser cutter to provide a minimal door-to-frame gap, $T_g$, between an outer edge of door 24 and an inner surface of member 32 on frame 22. Exemplary dimensions for $T_g$ include 1/32 inch, or 1/16 inch, but can be larger or smaller as long as such dimension reduces or eliminates the ability to insert a significant structural end portion of a pry bar 33 therein to impart leverage.

Figure 10:
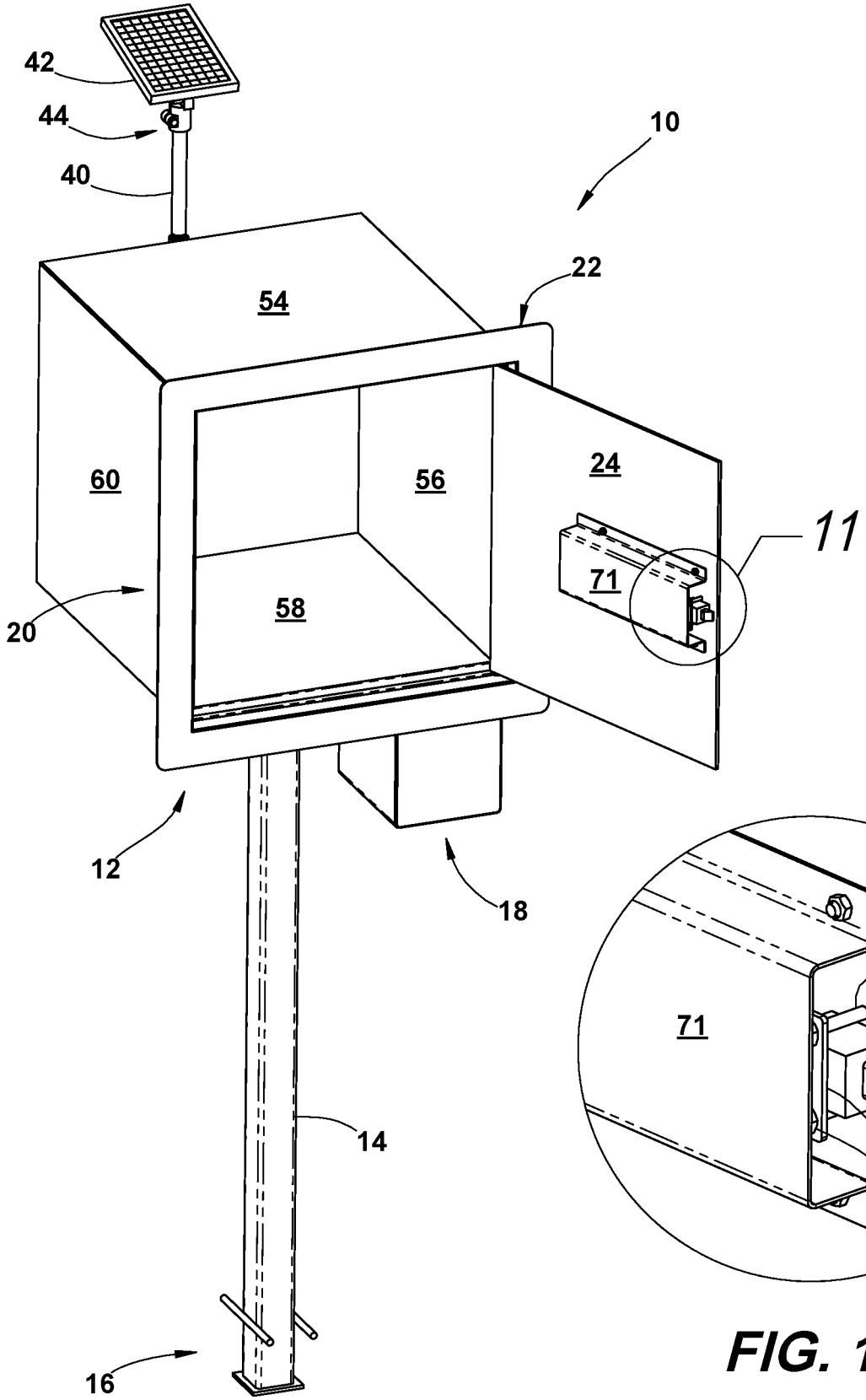
FIG. 10 is a front perspective view from above of the security package delivery system of FIGS. 1-9 with the door in an open and unlocked position.

FIG. 10 is a front perspective view from above of the security package delivery system 10 of FIGS. 1-9 with the door 24 in an open and unlocked position showing an interior volume configured to receive one or more packages for secure delivery to a user by a delivery person. Package storage space within security box 12 is formed between panels 54, 56, 58 and 60 and security door assembly 20 is preassembled and welded circumferentially to leading front edges of panels 54, 56, 58 and 60. A circumferentially extending right angle door frame 22 of assembly 20 provides structural strength to resist bending and or deformation of an open mouth otherwise provided by a front edge of box 12 along panels 54, 56, 58 and 60 as frame 22 is welded to box 12 along an entire periphery. Any bad actor, or thief using a pry bar attempting to leverage door 24 open will face difficulty as frame will resist any deformation and the insert positioning of door 24 inside of frame 22 denies a thief of sufficient fulcrum forces because the leverage will merely act in plane of door 24 being urged against frame 22 and will not provide out of plane forces necessary to pry door 24 from box 12.

As shown in FIG. 10, post 14 can be preassembled onto box 12 with solar panel 42, pipe bracket 44 and pipe mast 40, and battery box 18 and placed into a hole in the ground after which concrete is added around post anchor assembly to securely retain assembly 10 safely in the ground so as to mitigate any risk of theft.

Figure 11:
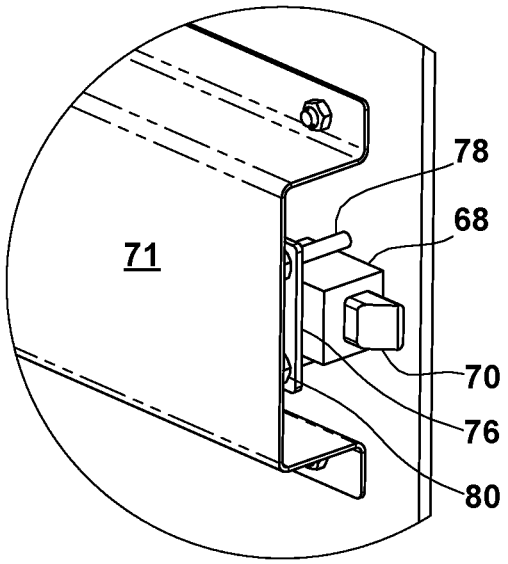
FIG. 11 is an enlarged perspective view of the latch assembly and security keypad guard from the encircled region 11 of FIG. 10.

FIG. 11 is an enlarged perspective view of the latch assembly 68 and security keypad guard 71 from the encircled region 11 of FIG. 10. Guard 71 is formed from a folded segment of steel sheet metal configured to protect a keypad and controller therein from insertion and removal of packages. A steel security retaining plate 76 provides extra structural retention of latch assembly 68 and latch 79 and affixed to hardened bolt assemblies 76 and 78 that also retain handle 28 (see FIG. 9).

Figure 12:
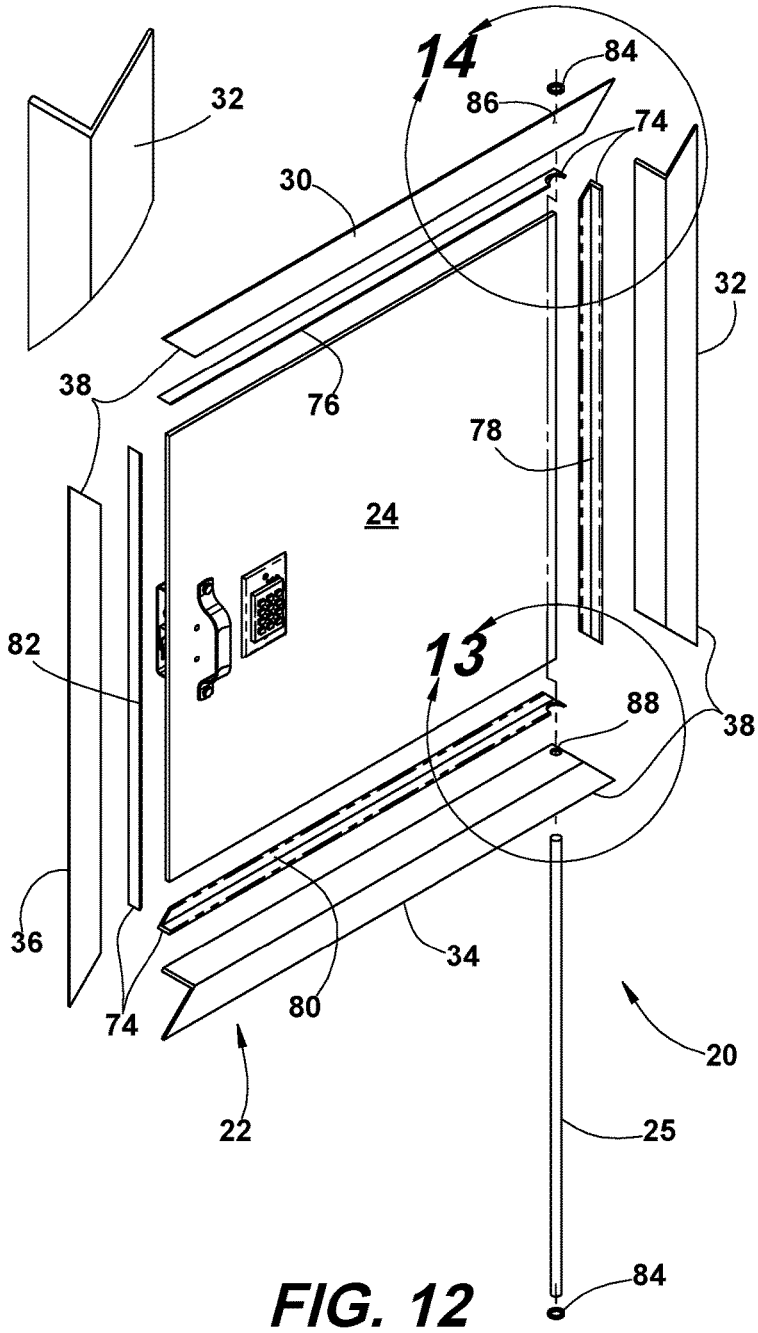
FIG. 12 is an exploded front perspective view from above of the security door and frame assembly.

FIG. 12 is an exploded front perspective view from above of the security door and frame assembly 20 used in FIGS. 1-11. More particularly, door frame 22 is formed by welding together 45 beveled ends of right angle frame members 32, 32, 34 and 36, as well as right angle frame members 76, 78, 80 and 82. The resulting circumferential outer right angle frame assembly 38 and inner right angle frame assembly 74 are then welded together in one continuous weld bead, or in a series of weld beads to form door frame 22.

One important security feature is the manner in which door 24 is inset a couple of inches within frame 22 (relative to a front face) in order to minimize risk of someone successfully engaging a pry bar between door 24 and gaining sufficient leverage to dislodge door from frame 22. According to one construction, frame members 30, 32, 34 and 36 are each 2" by 2" right angle steel frame members that are welded together along abutting angled ends to form right angle corners. Another important security feature is the manner in which door 24 is installed and entrapped within frame 22 during assembly. More particularly, top frame member 30 and bottom frame member 34 each have a hinge pin clearance hole 86 and 88, respectively, configured to receive a hardened pivot rod 25 for rotation. After welding together frame assemblies 38 and 74, rod 25 is inserted into holes 86 and 88 and a thick washer, such as a flattened lock washer, is welded onto each end of rod 25, entrapping rod 25 onto frame 22. Subsequently, door 24 is inserted within frame 22 and abutted against rod 25 where the two are welded together with one or more weld segment. This assembly entraps door 24 and hinge rod 25 within frame making attempts to breach door 24 with a pry bar exceedingly difficult due to the welded together and entrapped assembly components.

Figure 13:
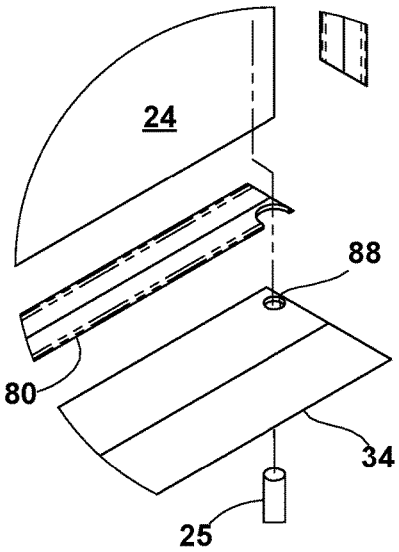
FIG. 13 is an enlarged perspective view of a bottom hinge pin assembly from encircled region 13 of FIG. 12.

FIG. 13 is an enlarged perspective view of assembly for a bottom portion of hinge pin, or rod 25 onto member 34 from encircled region 13 of FIG. 12. A clearance cut is provided in frame member 80 to provide assembly clearance for rod 25 as it passes through bore 88 upwardly along door, or panel 24.

Figure 14:
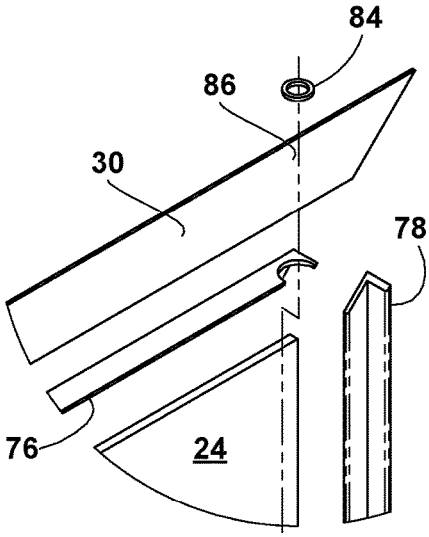
FIG. 14 is an enlarged perspective view of a top hinge pin assembly from encircled region 14 of FIG. 12.

FIG. 14 is an enlarged perspective view of assembly for a top portion of hinge pin, or rod 25 (see FIG. 12) from encircled region 14 of FIG. 12. More particularly, washer 84 and bore 86 are shown relative to frame member 30 configured to receive a top portion of the rod in assembly. Inner frame member 76 also has a clearance cut, or relief to enable passage of the hinge rod. Door 24 abuts against inner frame member 78 when closed, which is welded onto outer frame member 32.

Figure 15:
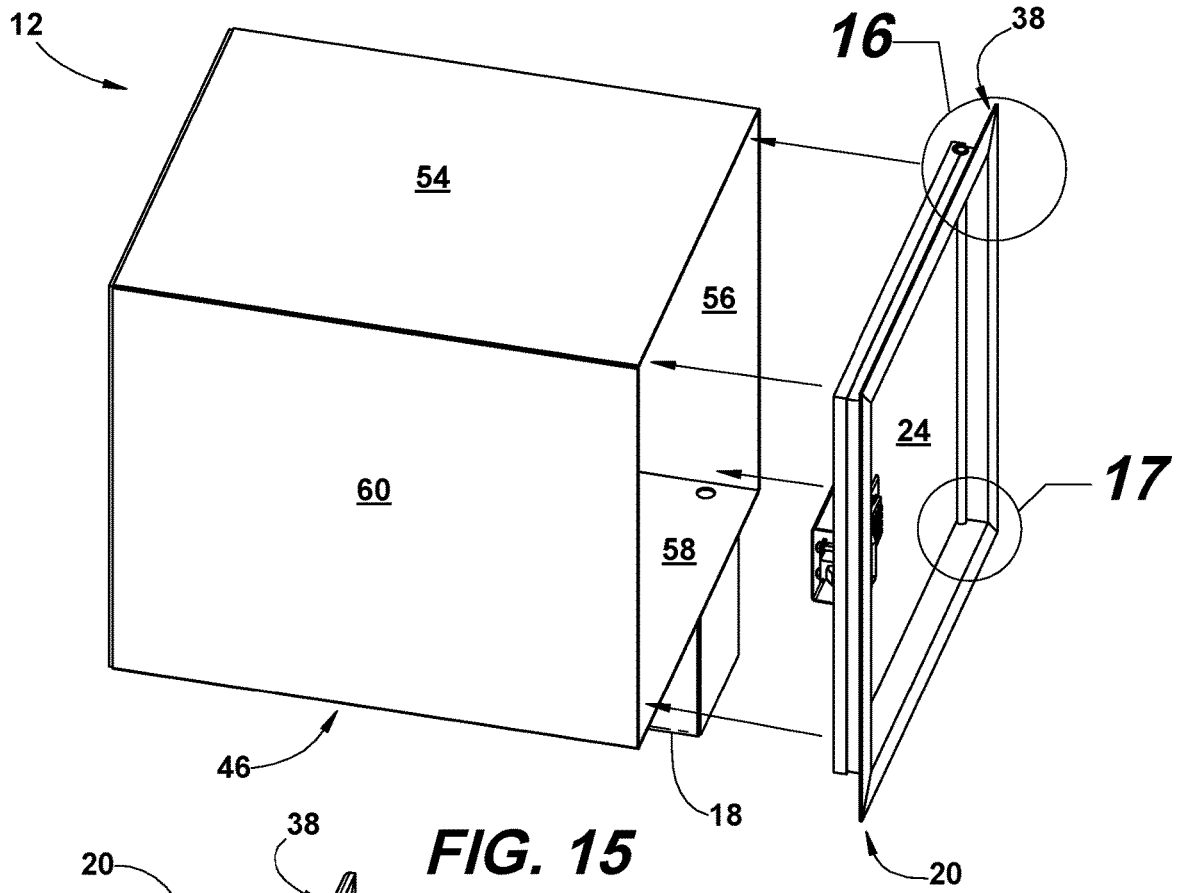
FIG. 15 is a front side perspective view from above of the security package delivery system showing assembly of the security door and frame onto a security box.

FIG. 15 is a front side perspective view from above of the security box for the security package delivery system of FIGS. 1-14 and showing assembly of the security door and frame onto a security box. More particularly, a box body is preassembled by edge welding together steel body panels 54, 56, 58 and 60. A locking battery box 18 is also welded onto a bottom surface of panel 58. Preassembled and welded security door assembly 20 is then inserted within an open mouth of box body 46 and is welded onto open leading edges of panels 54, 56, 58 and 60 with one or more weld segments to secure assembly 20 securely onto box body 46. Door 24 is shown recessed from a frontmost surface of outer right angle frame 38 which makes it difficult for a thief to insert a pry bar and get enough leverage to pry door 24 open relative to frame 20.

Figure 16:
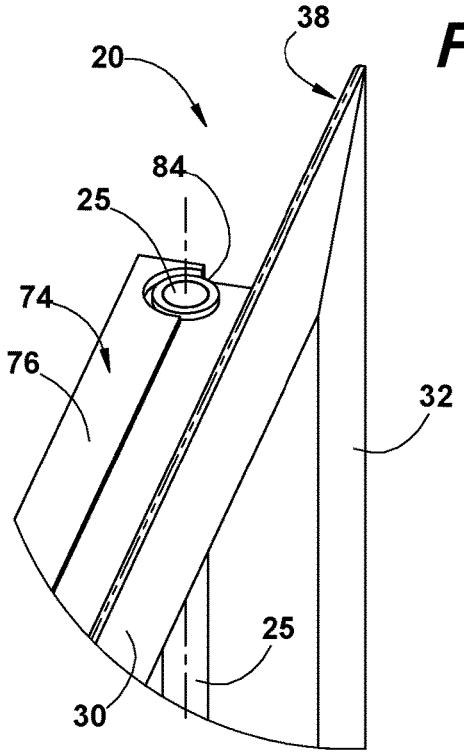
FIG. 16 is an enlarged perspective view from above of the encircled region 16 of FIG. 15 illustrating a top-most hinge pin locked in assembly onto the frame.

FIG. 16 is an enlarged perspective view from above of the encircled region 16 of FIG. 15 illustrating a top-most hinge pin, or rod 25 locked in assembly onto frame 20. Thick washer 84 is circumferentially welded onto a top end of rod 25. According to one construction, washer 84 is a thick lock washer than has been pressed into a flat configuration and welded to form a circle. Frame member 76 of frame assembly 74 has a semicircular relief cut sized to provide clearance for washer 84 and rod 25. Outer right angle frame 38 is formed by end welding together frame members 30 and 32 which provides a strengthening flange along an otherwise open front end of the security box, imparting structural strength to resist attempts to deform and breach door 24 relative to frame 20 using a pry bar.

Figure 17:
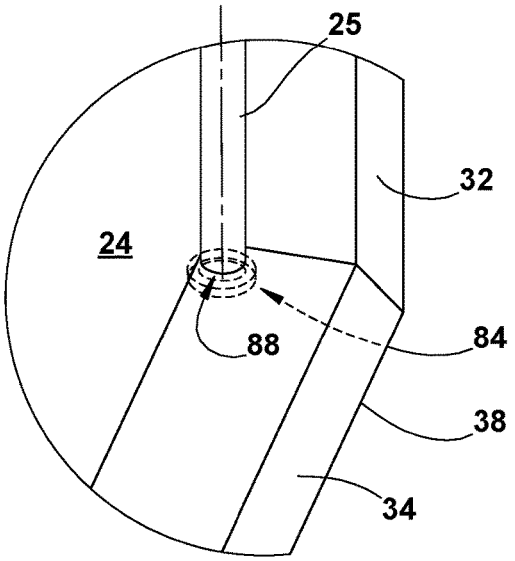
FIG. 17 is an enlarged perspective view from above of the encircled region 16 of FIG. 15 illustrating a bottom-most hinge pin locked assembly onto the frame.

FIG. 17 is an enlarged perspective view from above of the encircled region 16 of FIG. 15 illustrating a bottom-most hinge pin, or rod 25 shown locked into assembly onto right angle frame 38. Rod 25 is entrapped onto frame member 34 with a welded washer 84 (see FIG. 12 for further detail). Door 24 is edge welded along rod 25 as rod 25 is entrapped to rotate within bore 88. Frame member 32 is welded along both flanges via a 45 degree cut onto a corresponding cut end of frame member 34.

Figure 18:
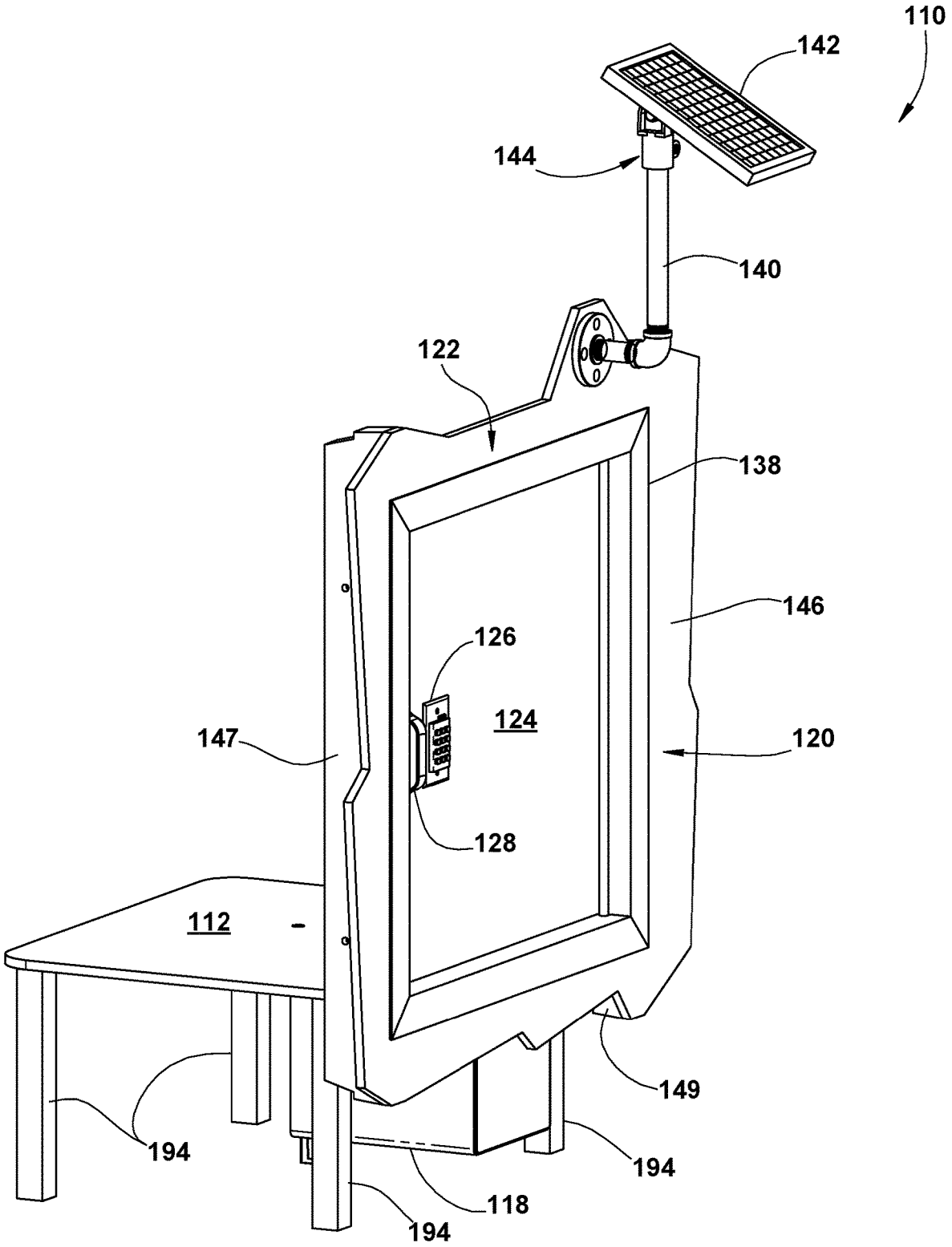
FIG. 18 is a perspective view from above and in front of another secure package delivery system according to another aspect having a security door system mounted into a wall portion of a building.

FIG. 18 is a perspective view from above and in front of another secure package delivery system 110 according to another aspect having a security door assembly 120 mounted into a wall portion 146 of a building. Door frame 122 is affixed with lag bolts 192 into opposed adjacent vertical wooden studs 147 and 149 in wall 146. Optionally, any form of fastener or bolt could be used for installation into a wall including welding. A package shelf 112 is welded onto a bottom frame member of door frame 122 and a battery box 118 is affixed with fasteners, or welded onto a bottom surface of shelf 112. Solar panel 142, bracket 144 and pipe mast 140 are affixed onto building wall portion 138 with internally lead electrical wiring going into the building and down into battery box 118 where a charge controller charges a battery (not shown). Door 124 with keypad 126 and handle 128 are recessed within right angle frame 138 of door frame 122 to provide further anti-theft break-in resistance from someone attempting to pry door 124 from frame 122.

Figure 19:
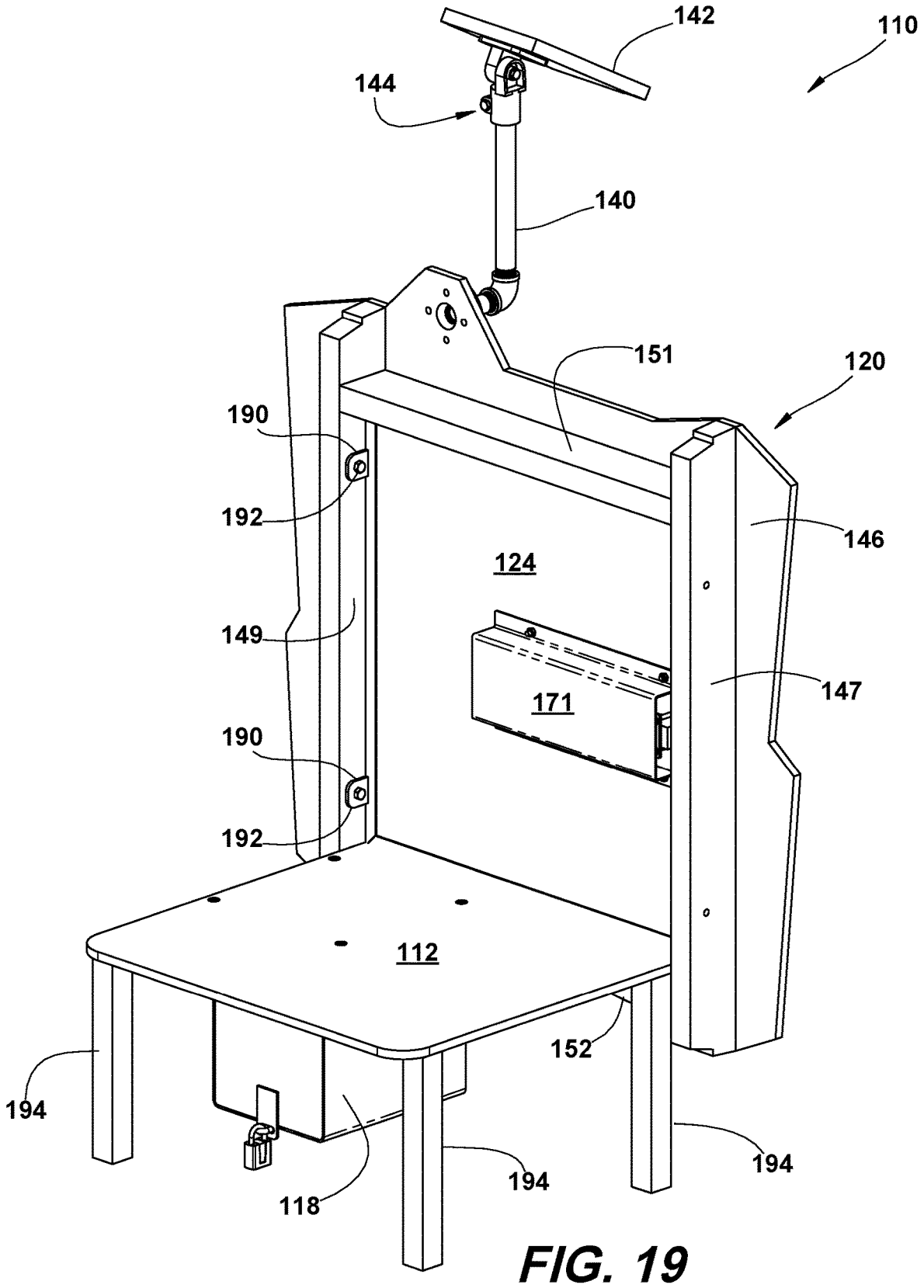
FIG. 19 is a perspective view from above and behind of the security door system of FIG. 18.

FIG. 19 is a perspective view from above and behind of the security door system 110 of FIG. 18. More particularly, the orientation of lag screws 192 received through steel retention tabs 190 on frame 122 serve to secure security door assembly 120 onto studs 147 and 149 of wall portion 146 of a building, such as a garage or home. Studs 147 and 149 are further affixed together with framing cross members 151 and 152. Details of package platform 112, including legs 194 (shown in a short configuration to sit atop a shelf in the building). Legs are sufficiently long to provide clearance and access to locking battery box 118. Solar panel 142, adjustment bracket 144 and pipe mast 140 are shown affixed with an elbow pipe fitting onto wall portion 146 and provide a path to pass electrical wiring from panel 142 into the building and down to a charge controller and a battery inside battery box 118. Sheet metal guard 171 is affixed with a plurality of threaded fasteners onto threaded studs welded onto a back side of door 124 in order to protect internal components from damage and contact with packages while being inserted and removed.

Figure 20:
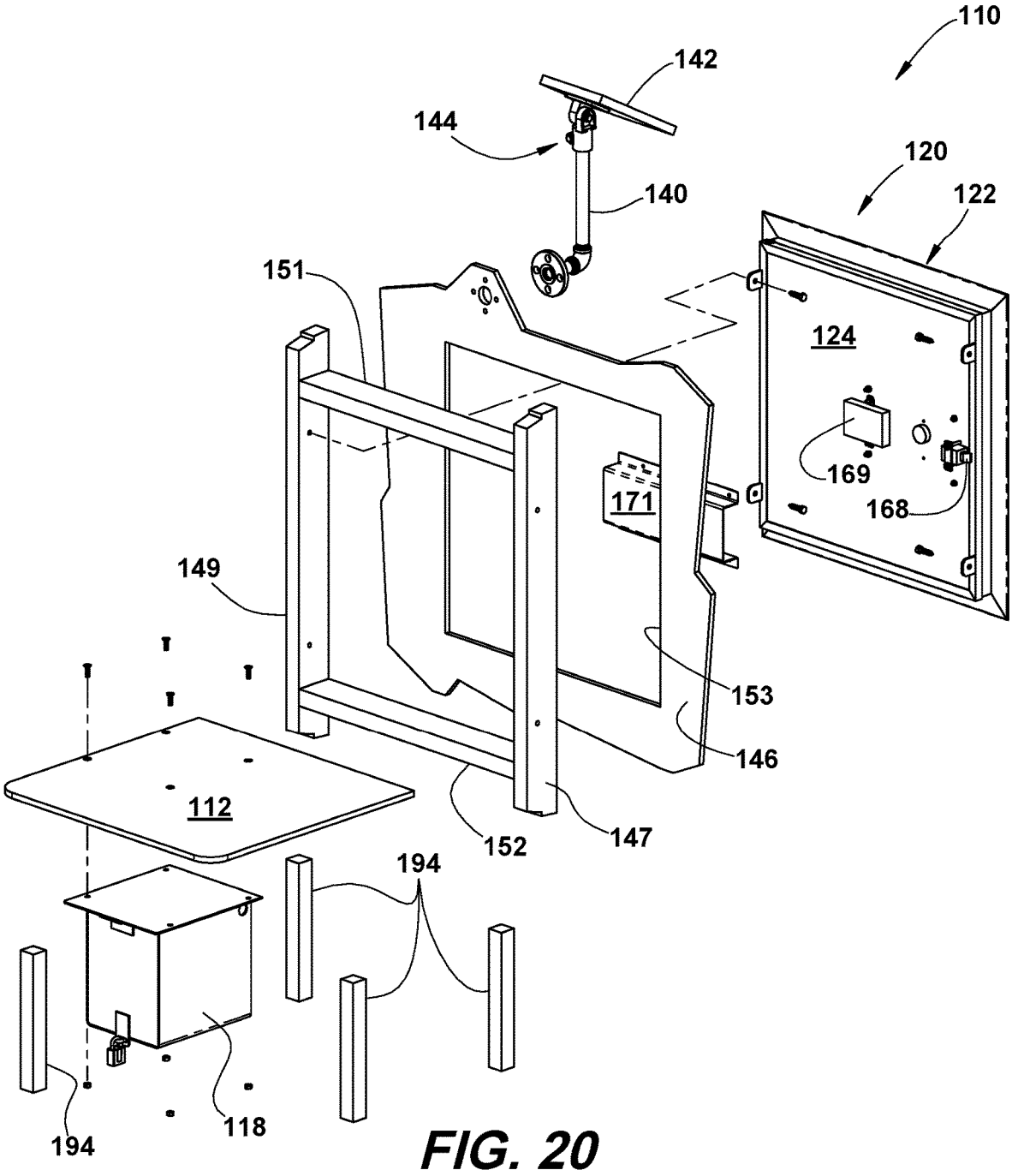
FIG. 20 is an exploded perspective view from above and behind of the security door system of FIG. 19.

FIG. 20 is an exploded perspective view from above and behind of the security door system 110 of FIG. 19. More particularly, assembly of security door assembly 120 and door frame 122 within an aperture 153 in a wall portion 146 onto structural wall studs 147 and 149 and cross members 151 and 152 provides significant resistance to package theft and damage to system 110. Solar panel 142, adjustable bracket 144 and pipe mast 140 also affix with fasteners (not shown) onto a wall portion 146 of a building. Assembly of legs 194 with welds onto a bottom surface of package shelf 112 is shown. Battery box 118 is shown affixed with fasteners onto a bottom surface of package shelf 112. However, box 118 can alternatively be welded onto a bottom surface of shelf 112 when made of metal or steel. Steel sheet metal guard 171 is affixed with fasteners to a back side of door 124 in order to protect latch assembly 168 and keypad and lock control box, or unit 169.

As shown in FIGS. 1-20, power supply controller (#69 and #169) in one suitable form is commercially available as an AMOCAM, K80 Power Supply Control, AC 110-240 V to DC 12 V power supply for door access control equipment, electric strike lock, bolt lock and magnetic bolt lock and as a general power supply controller, commercially available from the AMOCAM Store on Amazon.com, https://www.amazon.com/AMOCAM-110-240V-Intercom-Electric-Controller/dp/B06XRVMGDN?ref_=ast_sto_dp. Other comparable power supplies having control circuitry, processing circuitry, and memory can also be used.

Also shown in FIGS. 1-20, keypad (#26 and #126) in one suitable form is available as a Retekess T-AC03 Security Access Control Keypad, weatherproof door access control, commercially available from The Retekess on Amazon.com, https://www.amazon.com/TIVDIO-Control-Outdoor-Waterproof-Stand-alone/dp/B01MSZC2AP?ref_=ast_sto_dp. Other comparable keypads can also be used.

Further shown in FIGS. 1-20, latch assembly (#68 and #168) in one suitable form is commercially available as a KUJBUY DC 12 V, 1.1 A, 11.4 mm electromagnetic solenoid lock assembly for electric door lock, sold by Amazon.com, https://www.amazon.com/Electromagnetic-Solenoid-Assembly-Electric-Cupboard/dp/B08L83SSHQ/ref=sr_1_12?crid=2KL830AZ6MZ0S&keywords=electronic+door+latch+lock+open+frame+12 v+solenoid+electric+uxcel&qid=1661966144& sprefix=electronic+door+latch+lock+open+frame+12 V+solenoid+electric+uxcel %2C apg %2C273&sr=8-12.

Additionally shown in FIGS. 1-20, a charge controller is provided in the battery box (not shown) between the battery and the solar panel. One suitable form is commercially available as a POWOXI solar panel charge controller, 8A battery regulator for solar battery charger, solar battery maintenance and 12 V battery power, sold by Amazon.com, https://www.amazon.com/ZEALLIFE-Controller-Regulator-Maintainer-Protection/dp/B07F85CDM6/ref=sr_1_14?crid=3NG7KBRPK0ZAQ&keywords=12+volt+solar+charge+controller&qid=1661966724&sprefix=12+volt+solar+charge+controller % 2Caps %2C158&sr=8-14.

Even further shown in FIGS. 1-20, one suitable solar panel is provided commercially available as a Suner Power 50 Watts mono crystalline, 12 V solar panel kit including a 10 A charge controller, sold by Amazon.com, https://www.amazon.com/SUNER-POWER-Watts-Crystalline-Solar/dp/B07WYZPN2B/ref=sr_1_1_sspa?keywords=50w %2B12v %2Bsolar %2Bpa nel&qid=1661972627&sr=8-1-spons&smid=A9FP6X594WAFM&th=1. Any other of a number of optional solar panels can also be used. Further optionally, a household power supply can be optionally provided to the secure package delivery system.

It is understood that the above control system includes control circuitry including processing circuitry and memory.

The terms “a”, “an”, and “the” as used in the claims herein are used in conformance with long-standing claim drafting practice and not in a limiting way. Unless specifically set forth herein, the terms “a”, “an”, and “the” are not limited to one of such elements, but instead mean “at least one”.

In compliance with the statute, the subject matter disclosed herein has been described in language more or less specific as to structural and methodical features. It is to be understood, however, that the claims are not limited to the specific features shown and described, since the means herein disclosed comprise example embodiments. The claims are thus to be afforded full scope as literally worded, and to be appropriately interpreted in accordance with the doctrine of equivalents.

I claim:

1. A security package delivery system, comprising:

at least one wall;

a door frame affixed to the at least one wall, the door frame having a circumferential frame with a door mounting frame inset into a recess relative to a front surface of the circumferential frame; and a door having a hinge rod extending through the door frame affixed at each end within a receiving bore of the door frame, the door mounting frame recessed relative to the front surface of the circumferential frame to mitigate fulcrum mechanical advantage with a pry bar from prying the door from the door frame.

2. The security package delivery system of claim 1, wherein the hinge rod is welded onto one edge of the door recessed within the door frame.

3. The security package delivery system of claim 2, further comprising an enlarged retaining ring affixed onto each end of the hinge rod configured to entrap the door and the rod within the door frame.

4. The security package delivery system of claim 1, wherein the at least one wall comprises a welded metal security box having an entrance opening to which the door frame is affixed.

5. The security package delivery system of claim 1, wherein the at least one wall comprises a building wall portion into which the door frame is affixed.

6. The security package delivery system of claim 1, wherein the door has a peripheral flange extending outwardly of the door configured to add structural strength to the at least one wall relative to the door.

7. The security package delivery system of claim 1, further comprising a keypad, a lock mechanism, and a controller configured to latch and unlatch the door relative to the door frame responsive to a security code input.

8. The security package delivery system of claim 7, further comprising a solar panel affixed to the at least one wall, a battery, and a charge controller configured to power the keypad, the lock mechanism and the controller.

9. The security package delivery system of claim 8, further comprising a locking battery box affixed to the at least one wall configured to retain the battery electrically coupled with the charge controller and the solar panel.

10. The security package delivery system of claim 1, wherein the hinge rod is welded along a contacting edge of the door and extends beyond the door frame at each end to entrap the door and hinge rod within the door frame when welded together.

11. The security package delivery system of claim 10, further comprising an enlarged metal ring welded at each end of the hinge rod to further entrap the hinge rod within the door frame.

12. A security package delivery system, comprising:

a door frame configured to be affixed to a wall portion, the door frame having a circumferential frame with a door mounting frame recessed relative to a front surface of the circumferential frame; and a door having a hinge rod extending through the door frame affixed at each end within a receiving bore of the door frame, the hinge rod affixed to the door with each end of the hinge rod entrapped within opposed ones of the receiving bores within the door frame, the door mounting frame recessed relative to the front surface of the circumferential frame to mitigate fulcrum mechanical advantage with a pry bar from prying the door from the door frame.

13. The security package delivery system of claim 12, further comprising an enlarged end fitting affixed to each end of the hinge rod configured to further entrap the door and hinge rod within the door frame.

14. The security package delivery system of claim 13, wherein each of the enlarged end fittings comprise a metal washer welded onto a respective end of the hinge rod.

15. The security package delivery system of claim 14, wherein the wall portion comprises a front surface of a security box.

16. The security package delivery system of claim 15, further comprising a support post having a post anchor assembly, a top portion of the support post affixed to a bottom panel of the security box and the post anchor assembly affixed to a bottom portion of the support post configured to be inserted and retained in concrete within a hole in a ground placement location.

17. The security package delivery system of claim 16, further comprising a locking latch assembly, a controller signal coupled with the latch assembly, and an access keypad signal coupled with the controller, the controller coupled to a power supply.

18. The security package delivery system of claim 17, further comprising a solar panel, a charge controller electrically coupled to the solar panel, a battery electrically coupled to the charge controller, and a battery box affixed to the security box configured to house the battery and the charge controller, wherein the battery provides the power supply.

19. The security package delivery system of claim 14, wherein the wall portion comprises a wall segment of a building having an aperture configured to receive the door frame and the door.

20. A method of securing a package, comprising:

providing a storage encasement having a wall portion, a frame affixed to the wall portion, a door recessed relative to an outer surface of the frame to mitigate mechanical advantage from prying the door from the frame, a hinge rod extending at opposed ends through bores in the frame recessed relative to the outer surface of the frame, and a locking latch assembly configured to affixed the door and the hinge in a recessed closed position within the frame;

entrapping the door and the hinge rod by affixing the door to the hinge rod while the hinge rod is entrapped within the bores of the frame; and locking the door and the hinge rod in a recessed position relative to the outer surface of the frame with the locking latch assembly.

21. The method of claim 20, further comprising affixing an enlarged fitting onto the opposed ends of the hinge rod after entrapping the hinge rod within the bores of the frame.

22. The method of claim 21, further comprising sizing an outer periphery of the door having a gap with an inner surface of the frame of less than or equal to 1/16th of an inch.

* * * * *